US005724669A

United States Patent [19]

Snyder et al.

[11] Patent Number: 5,724,669

[45] Date of Patent: Mar. 3, 1998

[54] METAL DECONTAMINATION PROCESS AND SYSTEMS FOR ACCOMPLISHING SAME

[76] Inventors: Thomas S. Snyder, 214 Briarcliff Ave., Oak Ridge, Tenn. 37830; Thomas V. Congedo, 1460 Laurel Dr., Pittsburgh, Pa. 15235; William H. Carder, 12009 Butternut La., Knoxville, Tenn. 37922; George Collins, 103-M Gates Dr., Oak Ridge, Tenn. 39830; Ellen V. Gray, 205 Outer Dr., Oak Ridge, Tenn. 37830; Frank H. Ruddy, 2101 Pendleton Dr., Monroeville, Pa. 15146

[21] Appl. No.: 732,558

[22] Filed: Oct. 15, 1996

(Under 37 CFR 1.47)

[51] Int. Cl.[6] ..... G21E 9/00

[52] U.S. Cl. ..... 588/2; 588/11; 588/201; 110/237; 75/10.14; 75/10.46; 75/377; 266/201; 266/205; 266/227; 223/5

[58] Field of Search ..... 558/2, 11, 201; 110/237; 75/10.14, 10.46, 384, 386, 377; 266/202, 205, 227; 423/5

[56] References Cited

U.S. PATENT DOCUMENTS

| | | | |
|---|---|---|---|
| H970 | 10/1991 | Snyder et al. | 204/105 R |
| 4,004,918 | 1/1977 | Fukouka et al. | 75/11 |
| 4,395,367 | 7/1983 | Rohrmann et al. . | |
| 4,675,048 | 6/1987 | Maillet | 75/10.14 |
| 5,071,471 | 12/1991 | Miki et al. | 75/10.14 |
| 5,133,901 | 7/1992 | Peterson et al. | 252/626 |
| 5,348,567 | 9/1994 | Chappell | 75/10.66 |
| 5,414,195 | 5/1995 | Peterson et al. | 588/1 |
| 5,626,086 | 5/1997 | Malone | 110/190 |
| 5,640,710 | 6/1997 | Kobayashi et al. | 588/201 |

OTHER PUBLICATIONS

Blatz, H., *Sale of Uranium Contaminated Steel Scrap*, The Iron Age, Sep. 25, 1952 (pp. 125–127).

Klevin et al., *Remelting May Permit Reclaiming Uranium–Contaminated Metals*, American Physical Society Meeting, Washington, DC, Apr. 26–28, 1956.

*Primary Examiner*—Ngoclan Mai

[57] ABSTRACT

The present invention provides for methods for on-line monitoring of a molten process phase to determine the extent of extraction of radioactive species from a waste metal contaminated with the radioactive species. The waste metal is mixed with an inorganic flux material in a furnace, wherein the flux material extracts the radioactive species from the waste metal. Periodically, a portion of the furnace composition is sampled from the furnace and separated into a molten flux phase and a molten metal phase. Either of these phases is then analyzed in its molten state to determine the extent of the extraction process.

19 Claims, 1 Drawing Sheet

METAL DECONTAMINATION PROCESS AND SYSTEMS FOR ACCOMPLISHING SAME

FIELD OF THE INVENTION

The present application relates to methods for contacting scrap metal contaminated with radioactive species with a flux material in a smelting operation to decontaminate the metal. More specifically, the inventive methods provide for improved, higher efficiency extraction of the radioactive species by the flux phase due to controlled on-line monitoring of the extraction process.

BACKGROUND OF THE INVENTION

There currently exists vast quantities of scrap metals contaminated with radioactive species. Typically, these scrap metals are created at nuclear facilities where various metal and metal alloy substrates come into contact with radioactive sources. The base metal and metal alloy substrates generally include iron/iron alloys, copper/copper alloys, and aluminum/aluminum alloys. The most common radionuclides present in these metallic substrates include uranium and technetium.

Previous efforts have been made to decontaminate these radioactive waste metals by smelting the metals, partitioning radioactive contaminants to inorganic flux/slag phases by high temperature, inorganic solvent extraction, and separating the resultant slag. Such processes, although valuable with respect to the lowering of the radionuclide content within the metallic substrate, have severe drawbacks.

First, these processes are conducted in a batch mode and the resultant decontaminated metallic substrate may require a further smelting treatment to reduce the radionuclide content to acceptable levels. Current process approaches cannot assess the need for a second contact stage without either cooling and analyzing the product or holding the reactor in a hot hold state for prolonged periods while chemical assays are performed on the metal phase. Both approaches increase heating loads and operating costs.

Second, the radionuclide content in the metallic substrate can only be determined by solidifying the melt. However, upon solidification the radionuclides migrate to the outer layers of the product ingot by zone-refining transport. Thus, the normal and expedient techniques of analysis, conducted on the outer surface of the product ingot, do not necessarily reflect the actual radionuclide content with the metallic substrate. As a corollary to this, proper analysis of the product ingot typically entails statistical sampling procedures on the ingot resulting in increased costs for quality control purposes.

Therefore, a need exists in the art to provide improved methods for decontaminating metal substrates containing unacceptable levels of radionuclide species. There further exits a need to provide process equipment systems for practicing these methods.

SUMMARY OF THE INVENTION

The present invention provides methods for on-line monitoring of a molten process phase to determine the extent of extraction of radioactive species from a contaminated metal. The present invention also provides for the system to conduct the methods.

In one embodiment, a waste metal material contaminated with at least one radioactive species, is mixed with an inorganic flux composition in a furnace, preferably an induction furnace, to form a molten furnace composition. The molten furnace composition is thus a mixture of the molten waste metal material and the molten flux material. The molten flux material extracts a portion of the radioactive species from the waste metal material. Periodically, a portion of the molten furnace composition is removed from the furnace and separated into a sampling molten flux phase and a sampling molten metal phase. Either, or both, of these sampling phases are then analyzed in their molten state to determine either: (1) the extent of extraction of the radioactive species from the waste metal into the flux compositions; (2) the level of the radioactive species in the sampling molten flux phase; or (3) the level of the radioactive species in the sampling molten metal phase. The analysis of the molten phases is preferably by a prompt gamma neutron activation analysis (PGNAA) system.

In another aspect of the invention, the information gained from the analysis of the molten flux and/or metal phases is used to control the extraction process. This control is preferably conducted by a centralized computer controller that can monitor the extraction process and thereby regulate the discharge of the molten furnace composition from the furnace, and direct the separated molten flux phase and/or the separated molten metal phase to be recycled in the extraction process or to be stored. The spent flux material can then be discarded, while the finished metal material can be stored.

DETAILED DESCRIPTION OF THE INVENTION

Figure 1:
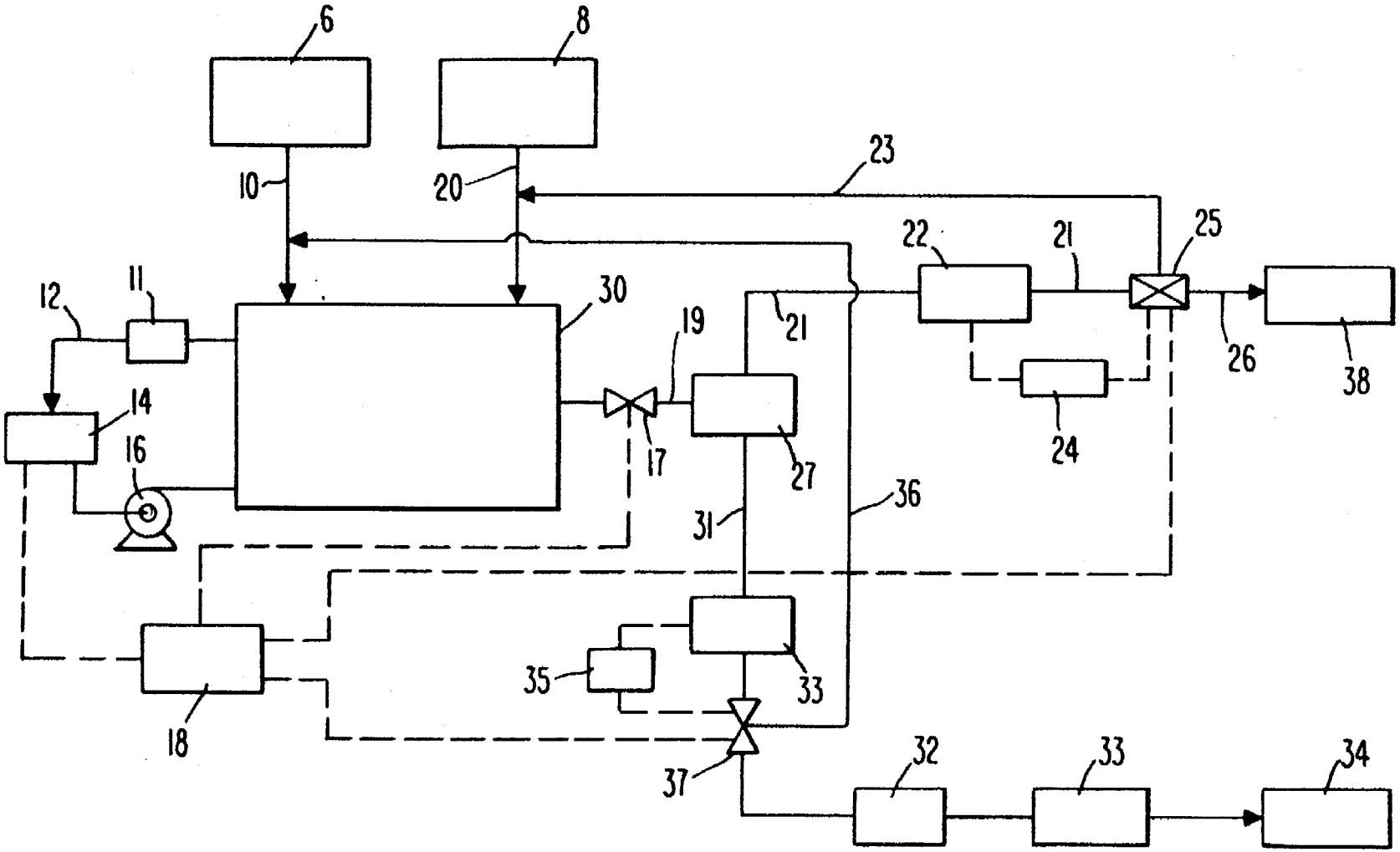
FIG. 1 is a schematic diagram displaying one process lay-out for decontaminating metal in accordance with the present invention.

The present invention provides for methods for decontaminating waste metal materials that are contaminated with radionuclides and the apparatus used to conduct those methods. Typical radionuclide contaminants include such elements as uranium and technetium. The base metal and metal alloy substrates generally include iron/iron alloys, copper/copper alloys, nickel/nickel alloys, tin/tin alloys, and aluminum/aluminum alloys. In accordance with the present invention, the contaminated scrap metal substrate is smelted in a furnace in the presence of a flux material. The flux material extracts the radionuclide species from the molten scrap metal and this process is monitored to optimize the contact time between the flux and the metal, to determine the ability of the slag to effectively remove the radionuclide contaminants, and to determine the level of decontamination in the smelted metal to determine when the smelting process can be discontinued.

The levels of contamination of the base metal substrates varies depending on the source of the scrap metal. Typically, uranium levels in the base metal run from about 0.5 to about 50 ppm, and technetium levels from about 0.5 to about 20 ppm, although such contents can be higher.

The processes and processing systems of the present invention can be more readily understood by reference to FIG. 1 wherein a particular embodiment of the present invention is shown. The scrap metal materials are stored in container 6. These metals are preferably analyzed prior to the initiation of the decontamination efforts to determine the level and composition of the radionuclide contaminants. This information is then utilized to select a candidate extraction flux material. In certain instances, the feed material can be subjected to a surface abrasion or chemical decontamination process to reduce the radioactivity level of the metal substrate. This process may function as a pretreatment stage, or may, on the occasion that the contamination is limited to the surface only, result directly in releasable product. The scrap metal material is then transferred via line 10 into the furnace 30.

The furnace 30 can be of any design commonly employed for the smelting of metallic alloys. An example of such a furnace is an induction melt furnace. The induction melt furnace typically has either a metallic alloy or ceramic crucible within which the scrap metal is contained. The temperatures within the operating furnace are generally from about 1000° C. to 1700° C.

The radionuclide contamination level within the scrap metal is reduced within the furnace 30 by contacting the now molten metal with an extraction flux material. These flux materials can include $SiO_2$, CaO, $Al_2O_3$, CuO, $Fe_2O_3$, $CaF_2$, NaF, $AlF_3$, NaOH, NaCl, and mixtures thereof. For example, fluxes that are particularly useful in the decontamination of mild steels include: (1) $CaO/Fe_2O_3$, (2) $CaO/Al_2O_3$, (3) $CaO/SiO_2/Fe_2O_3/CaO$, or $SiO_2/Al_2O_3$, for use in quartz, alumina, and zirconia crucibles; fluxes useful in the decontamination of stainless steel include: (1) $SiO_2/Al_2O_3$, (2) $SiO_2/CaO/Al_2O_3/CaF_2$, (3) $CaO/SiO_2$, and (4) $CaO/SiO_2/Al_2O_3/CaF_2$ in graphite, zirconia and magnesia crucibles; fluxes useful in the decontamination of copper-based metals include: (1) $SiO_2/CaO/Al_2O_3$, (2) $SiO_2/CaO/CaO$, (3) $SiO_2/C_uO/CaO/Al_2O_3$, and (4) $SiO_2/Fe_2O_3/CaO/Al_2O_3/CaF_2$ in alumina, zirconia, or graphite crucibles; fluxes useful in the decontamination of nickel-based metals include: (1) $SiO_2/CaO/Fe_2O_3$, (2) $CaO/SiO_2$, or (3) $CaO/SiO_2/Al_2O_3/Fe_2O_3/CaF_2$ in magnesia or zirconia crucibles.

The flux material can be transferred to furnace 30 via line 20. Within the furnace the flux material will be intimately mixed with the molten contaminated metal due to the action of the induction furnace. At this point, the radionuclides originating within the contaminated metal substrate are extracted into the flux material.

The smelting process in the presence of the extraction flux material is allowed to proceed for a period of time after which the process is monitored to determine if the metal is decontaminated to an acceptable level such that it is ready to pour, to determine the extraction rate within the furnace, or to determine if the flux material is exhausted or if it is still capable of removing radionuclides from the molten metal within the furnace. In one embodiment, the monitoring is conducted by extracting a small slip stream of the furnace 30 contents through line 12. The molten suspension of the metal and flux material is preferably passed through a separator 11 to separate the molten metal from the flux material. Examples of such separators 11 include settling vessels or ladels that are heated without the use of induction heating to avoid agitation of the slip stream outside the reactor. The flux and metal remain molten and separate by gravity so that sampling of the one phase can be accomplished without disturbing the other phase. After separation of the two streams, one or both of the streams are analyzed by the detector system 14. The extracted streams can then be recirculated into the furnace by means of high temperature pump 16, although gravity flow after tapping is also a means to recirculate the material.

The detection system 14 is preferably a prompt gamma neutron activation analysis (PGNAA) system. Such a detection system 14 operates by channeling the separated molten flux or molten metal slip streams through a chamber with dimensions selected to provide laminar flow and a volume optimized for PGNAA systems. PGNAA, which is a real-time non-destructive assay analytical technique, utilizes an isotopic (such as californium) or electronic (such as a deuterium-deuterium or deuterium-tritium) neutron generator to produce a neutron flux that is directed towards the sample. Thermal and epithermal neutron subatomic reactions within the sample produce nearly instantaneous "prompt gamma" rays, which are in turn, detected using an array of gamma (such as sodium iodide or germanium) detectors. These same gamma detectors are used in a time-sharing fashion to perform passive gamma spectroscopy of the gamma-emitting radionuclides contained within the sample. Sufficient gamma detectors of adequate efficiency surround the counting section directly downstream of the neutron irradiation field in such a manner as to effectively count the prompt gamma, neutron-induced decay gamma, and isotopic decay gamma energies emitted as result of the neutron interactions and natural decay of entrained radionuclides. The gamma detectors may also employ shielding and spectra-tailoring features such as collimation, gamma energy filtration, gamma and neutron shielding, and Compton suppression. The neutron generators may also employ neutron flux tailoring features including thermal absorbers to slow fast neutron flux (such as produced with electronic neutron generators), reflectors, shields, shutters, and pulse-timing electronics.

The multiple prompt gamma energies emitted by the irradiated sample are unique for each element or radioisotope, and are identified using PGNAA techniques similar to passive gamma spectroscopy of gamma-emitting radioisotopes. Inasmuch as the neutrons generated by the neutron generator are very penetrating, they are capable of assaying the entire sample geometry as set by the sample chamber dimensions. The chamber dimensions are selected to maximize the intensity of the neutron flux which interacts with the sample volume and minimize the effects of sample self-shielding of the resultant prompt gamma energies, as well as isotopic decay gammas associated with gamma-emitting radioisotopes. The chamber is constructed of materials capable of withstanding the temperature of the molten flux or molten metal slip streams, resistant to erosion and corrosion induced by the flowing molten flux and molten metal slip steams, and preferably containing only trace quantities of the materials intended to be assayed within the sample (to maximize the resultant signal-to-noise ratio).

The PGNAA background signature of the empty chamber is stored in a PGNAA control computer, and is automatically subtracted from the composite signal developed during sample assay to produce a signature of only the sample. The prompt gamma energies contained in the sample spectrum are analyzed by the control computer software, automatically adjusted based on previously developed calibration algorithms, and reported as weight percent or other appropriate engineering units. Additionally, the PGNAA control computer can use the resultant PGNAA information to develop an electronic signal proportional to the sample composition.

The PGNAA data collected from the irradiated stream is used to monitor the state of decontamination within the reactor. This information is used to determine whether the flux material is spent or whether it can continue to be used in an efficient manner in the extraction process. The information can also be used to determine whether the metal material is purified to an extent that the extraction process can be discontinued. In such a way, the PGNAA analysis can be used to assess whether equilibrium has been reached between the flux and metal phases by reference to computer generated models using the initial flux composition and initial metal phase composition as input data. The PGNAA analysis of the slip stream thereby provides for the ability to monitor the status of the extraction process and to determine if the flux material can be recycled for another process or whether it should be disposed, and whether the metal material should be recycled for continued processing or whether it can be removed as a purified product.

Detection systems employing techniques other than PGNAA and passive gamma spectroscopy may also be used to determine the composition of the molten flux and molten metal slip streams, and can be used instead of the PGNAA system for the detector system 14. Included within this list of techniques is X-ray Fluorescence (XRF), laser ablation/spark spectroscopy, photo-acoustic spectroscopy, Raman spectroscopy, gamma spectroscopy, alpha spectroscopy, passive-active neutron (PAN) assay, glow discharge vacuum (GDV) spectroscopy, and alpha/beta counting. These alternate and/or complimentary techniques would be used as described for PGNAA/passive gamma spectroscopy with the appropriate modifications for the individual technique. By combining techniques optimized for specific radionuclide and elemental assay, the composition of the molten flux and molten metal slip streams can be determined with sufficient confidence to permit real-time control of downstream control devices.

The analysis of the slip stream through the detector system 14 can be of the flux material or of the molten metal, or both. If the flux material is analyzed, the amount of radionuclide species within the flux material can be used to determine if the flux material is exhausted and should be replaced. If this is the case, the contents of the furnace 30, either entirely or a portion thereof, can be removed via line 19 to separator 27. The metal portion of the removed stream can be routed via line 31 and through valve 37 and through recycle line 36 back into the furnace for further processing. The exhausted flux material is routed via line 21 through valve 25 and through line 26 to a flux disposal vessel 38. Fresh flux material can then be sent to the furnace 30 from vessel 8 to restart the decontamination process. This monitoring/control system can be controlled by a central control system 18, such as a computer. The control system 18 receives input from the detector system 14. This input data is then used by control system 18 to control the values on the furnace exit line 19, the flux line 21 and the metal line 31. In this case, where the flux is spent, but the metal is not fully decontaminated, the control system 18 activates valve 17 to drain the flux/metal stream from the furnace into separator 27. The separated flux is then routed via line 21 and the control system 18 activates valve 25 to direct the flux into vessel 38 for disposal. The control system 18 further activates valve 37 so that the metal is routed through line 31 into line 36 and back into the furnace 30.

The analysis of the slip stream from the furnace 30 via line 12 can also be of the molten metal portion. If that material is sufficiently decontaminated, then the contents of the furnace 30 can be extracted via line 19 through separator 27. The separated metal phase can be transported via line 31 through valve 37 to a sampling and solidification system 32. The molten metal can be solidified within the solidification system 32 by such means as atomization or by simply pouring ingots. This solified metal can be further analyzed to ensure that its radionuclide level is within acceptable limits by detection system 33. Detection system 33 can be PGNAA, X-ray Fluorescence (XRF), laser ablation/spark spectroscopy, photo-acoustic spectroscopy, Raman spectroscopy, gamma spectroscopy, alpha spectroscopy, passive-active neutron (PAN) assay, glow discharge vacuum (GDV) spectroscopy, and alpha/beta counting interrogation techniques may be applied to the solidified metal in order to discern the radionuclide and elemental composition. These techniques may be applied to the surface of the metal casting, to cores, cross-sections, or other samples removed from the casting, or to the entire volume of the casting (using the above identified neutron interrogation techniques). The purified metal is then stored in vessel 34. The monitoring/control system as described can be controlled by the control system 18. The control system 18, upon receiving the input from the detection system 14 and concluding that the metal has been sufficiently purified, activates valve 17 to drain the furnace 30 contents into separator 27. The purified metal stream is then routed through valve 37, activated by control system 18, to direct the metal flow to solidification system 32. The flux portion is routed from separator 27 through valve 25, activated from the control system 18 to direct the flux through recycle line 23 for further use.

Standard passive gamma and alpha counting techniques are preferred for radionuclide assay of the solidified metal, while glow discharge vacuum (GDV) spectroscopy is preferred for determination of metallic constituents. In GDV spectroscopy, a small metallic wafer of the sampled metal is inserted into a chamber as a cathode. A low pressure inert gas environment is created around the sample by injecting a stream of argon gas into the sample chamber. The sample is given a −800 to −1200 volt negative potential. At the same time, spontaneously produced argon ions (Ar+) are accelerated across the anode/cathode gap by the negative potential. The argon ions collide with argon gas molecules creating a plasma which is referred to as a "glow discharge". Some of the high velocity argon ions impact the metallic surface of the sample and uniformly erode the sample substrate. This action is referred to as sputtering or milling out. Some of the eroded material diffuses into the glow discharge plasma where it is disassociated into atomic particles and excited. The light emitted from these excited state species, as they collapse back to lower energy levels, is characteristic of the elemental composition of the original sample. The wavelengths and intensity of the light emission are used to identify and quantify the composition of the sample.

The processing system of the present invention shown in FIG. 1 can further include detection systems on the molten metal and flux material lines, lines 31 and 21, respectively. Thus, the molten metal extracted from the furnace 30 can be analyzed by a detection system 33 similar to the detection system 14 described above. The detection system 33 can be electronically wired to a controller 35 that controls valve 37 and thus can direct the flow of the metal material either back to the furnace 30 or to the solidification system 32 depending on whether the metal is decontaminated to an acceptable level as analyzed by detection system 33. Also, the flux material extracted from the furnace 30 can be analyzed by a detection system 22 similar to the detection system 14 described above. The detection system 22 can be electronically wired to a controller 24 that controls valve 25 and thus can direct the flow of the flux material either back to the furnace 30 or to the flux disposal vessel 38 depending on whether the flux material is exhausted as analyzed by detection system 22.

What is claimed is:

1. A method for on-line monitoring a molten process phase to determine the extent of extraction of radioactive species from a contaminated metal, comprising:

(a) mixing a radioactive waste metal, said waste metal contaminated with at least one radioactive species, within an inorganic flux composition within a furnace and melting the waste metal and flux composition to form a molten furnace composition;

(b) extracting said radioactive species from the waste metal into the flux composition;

(c) periodically removing a portion of the molten furnace composition from the furnace and separating the molten furnace composition into a sampling molten flux phase and a sampling molten metal phase; and (d) analyzing either the sampling molten flux phase or the sampling molten metal phase to determine the extent of extraction of the radioactive species from the waste metal into the flux compositions, the level of the radioactive species in the sampling molten flux phase, or the level of the radioactive species in the sampling molten metal phase.

2. The method of claim 1 wherein the sampling molten flux phase is analyzed to determine the level of the radioactive species in the sampling molten flux phase.

3. The method of claim 2 further comprising removing at least a portion of the molten furnace composition from the furnace, separating the molten furnace composition into a production molten flux phase and a production molten metal phase.

4. The method of claim 3 further comprising recycling a portion the production molten flux phase for further use in the furnace in response to said analysis of the sampling molten flux phase.

5. The method of claim 3 further comprising disposing the production molten flux phase in response to said analysis of the sampling molten flux phase.

6. The method of claim 1 wherein the sampling molten metal phase is analyzed to determine the level of the radioactive species in the sampling molten metal phase.

7. The method of claim 6 further comprising removing at least a portion of the molten furnace composition from the furnace, separating the molten furnace composition into a production molten flux phase and a production molten metal phase.

8. The method of claim 7 further comprising recycling the production molten metal phase for further use in the furnace in response to said analysis of the sampling molten metal phase.

9. The method of claim 7 further comprising disposing the production molten metal phase in response to said analysis of said sampling motlen metal phase.

10. A method of on-line monitoring a molten process phase to determine extraction of radioactive species from a contaminated metal, comprising:

(a) mixing a radioactive waste metal, said waste metal contaminated with at least one radioactive species, within an inorganic flux composition within a furnace and melting the waste metal and flux composition to form a molten furnace composition;

(b) extracting said radioactive species from the waste metal into the flux composition;

(c) removing at least a portion of the molten furnace composition from the furnace and separating the molten furnace composition into a molten metal phase and a molten flux phase;

(d) analyzing either the molten metal phase or the molten flux phase to determine the level of the radioactive species in the analyzed molten phase.

11. The method of claim 10 wherein the molten metal phase is analyzed.

12. The method of claim 11 further comprising recycling the molten metal phase for use in the furnace in response to the analysis of the molten metal phase.

13. The method of claim 10 wherein the molten flux phase is analyzed.

14. The method of claim 13 further comprising recycling the molten flux phase for use in the furnace in response to the analysis of the molten flux phase.

15. A system for on-line monitoring a molten process phase to determine extraction of radioactive species from a contaminated metal, comprising:

(a) means for smelting a radioactive waste metal that is contaminated with at least one radioactive species and an inorganic flux composition, thereby forming a molten smelting compositions;

(b) means for separating the molten smelting composition into a molten metal phase and a molten flux phase, located in flow communication with the smelting means; and (c) means for analyzing either the molten metal phase or the molten flux phase for the level of the radioactive species in the analyzed phase, said analyzing means located in flow communication with the separation means.

16. The system of claim 15 wherein said analyzing means comprises a PGNAA system.

17. The system of claim 16 further comprising means for discharging the molten smelting composition from the smelting means, and further comprising control means connected to said analyzing means for controlling the discharging means.

18. The system of claim 16 further comprising means for directing the molten metal phase to either be reprocessed in the smelting means or to be stored as finished product, and further comprising control means connected to said analyzing means for controlling the molten method phase directing means.

19. The system of claim 16 further comprising means for directing the molten flux phase to either be reprocessed in the smelting means or to be stored as finished product, and further comprising control means connected to said analyzing means for controlling the molten method phase directing means.

* * * * *